US006671480B2

(12) United States Patent
Sugiyama

(10) Patent No.: US 6,671,480 B2
(45) Date of Patent: Dec. 30, 2003

(54) IMAGE FORMING APPARATUS

(75) Inventor: Hideaki Sugiyama, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/032,910

(22) Filed: Dec. 27, 2001

(65) Prior Publication Data

US 2003/0123906 A1 Jul. 3, 2003

(51) Int. Cl.[7] ..... G03G 15/01
(52) U.S. Cl. ..... 399/227; 399/222
(58) Field of Search ..... 399/53, 54, 115, 399/222, 223, 226, 227, 228

(56) References Cited

U.S. PATENT DOCUMENTS 4,935,778 A 6/1990 Mochida
5,552,877 A * 9/1996 Ishikawa et al. ..... 399/227

FOREIGN PATENT DOCUMENTS

JP 10-333385 A 12/1998
JP 2000-112196 A 4/2000

* cited by examiner

*Primary Examiner*—Hoang Ngo
(74) *Attorney, Agent, or Firm*—Frishauf, Holtz, Goodman & Chick, P.C.

(57) ABSTRACT

An image forming apparatus includes a developing device assembly, an inertia acceptor and a setting mechanism. The developing device assembly has a plurality of developing devices to develop a latent image formed on a photosensitive member. The assembly can rotate to switch from one of the developing devices to another. The energy of rotational inertia is shifted from the developing device assembly to the inertia acceptor when the inertia acceptor stops the rotation of the developing device assembly. The setting mechanism controls the movement of the inertia acceptor driven by the energy of rotational inertia shifted from the developing device assembly.

13 Claims, 9 Drawing Sheets

IMAGE FORMING APPARATUS

BACKGROUND OF THE INVENTION

1. Field of the Invention

This invention relates to an image forming apparatus to which electrophotography is applied and in which developing devices are used, switched from one to anther.

2. Description of the Related Art

Generally, an image forming apparatus to which electrophotography is applied have a photosensitive member, a charging device, an exposing device, a developing device, a transfer device and a fixing device. The photosensitive member may have an electrically charged area. This area is electrically discharged when light is applied to the photosensitive member. The charging device charges the photosensitive member. As the exposing device applies light to the photosensitive member, an electrostatic latent image is formed on the photosensitive member. As the developing device makes the electrostatic latent image attract toner, a visible toner image is formed on the surface of the photosensitive member. The transfer device transfers the toner image from the surface of the photosensitive member onto a recording sheet. The fixing device fixes the toner image that the transfer device has transferred onto the recording sheet.

Multi-color image forming apparatus have a developing device assembly that comprises a plurality of developing devices. The assembly is a means for forming multi-color images. Each developing device has a toner container. The toner containers store toners of different colors. In the multi-color image forming apparatus, the developing device assembly is rotated like a cylinder of a revolver to one developing device to another. The multi-color image forming apparatus forms a multi-color image on the surface of a recording sheet by repeating the image forming routine at the photosensitive drum, for the respective developing devices. Note that the image forming routine is a sequence of charging, exposing, developing and transferring. Since the image forming procedure is repeated as many times as the number of the developing devices, the multi-color image forming apparatus needs more time to form a complete image than the mono-color image forming apparatus.

Recently, there is a strong demand for multi-color image forming apparatus that can form images at high speed. One of the methods devised to meet the demand is to operate each device at high speed.

The developing device assembly is rotated intermittingly to switch one developing device to the next one. Each time the assembly starts or stops rotating, it vibrates due to its own moment of inertia. The vibration affects the image forming operation of the multi-color image forming apparatus.

If the exposing device vibrates, the light beam irradiating the surface of the photosensitive member may miss the target. If the developing device assembly vibrates, the distance between the developing device and the photosensitive member will change incessantly. The toner will be attracted, inevitably in uneven density, to the surface of the photosensitive member due to the electrostatic force. The faster the developing device assembly rotates, the greater the kinetic energy of the developing device assembly. Consequently, the vibration of the developing device assembly increases.

The vibrations of the devices result in misregistration of the color layers laid one on another. In order to avoid misregistration of colors, each device needs to wait until it ceases to vibrate, before it starts operating.

BRIEF SUMMARY OF THE INVENTION

An image forming apparatus according to an embodiment of the present invention is designed to reduce the vibration that occurs in each stop after switching one developing device to another in the developing device assembly that comprises a plurality of developing devices.

An image forming apparatus according to an aspect of the present invention comprises a developing device assembly, an inertia acceptor and a setting mechanism. The developing device assembly has a plurality of developing devices for developing a latent image formed on a photosensitive member. The assembly can rotate to switch one developing device to the next one. The energy of rotational inertia is shifted from the developing device assembly to the inertia acceptor, in order to stop the rotation of the developing device assembly. The setting mechanism controls the movement of the inertia acceptor that has received the energy of the rotational inertia from the developing device assembly.

An image forming apparatus according to another embodiments comprises a developing device assembly and an inertia acceptor. The developing device assembly has a plurality of developing devices for developing a latent image formed on a photosensitive member. The assembly can rotate to switch one developing device to the next one. The inertia acceptor shifts the energy of rotational inertia to the developing device assembly to make the assembly start rotating, and is shifted the energy of rotational inertia from the developing device assembly in order to stop the rotation of the developing device assembly.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serves to explain the principles of the invention.

DETAILED DESCRIPTION OF THE INVENTION

Figure 1:
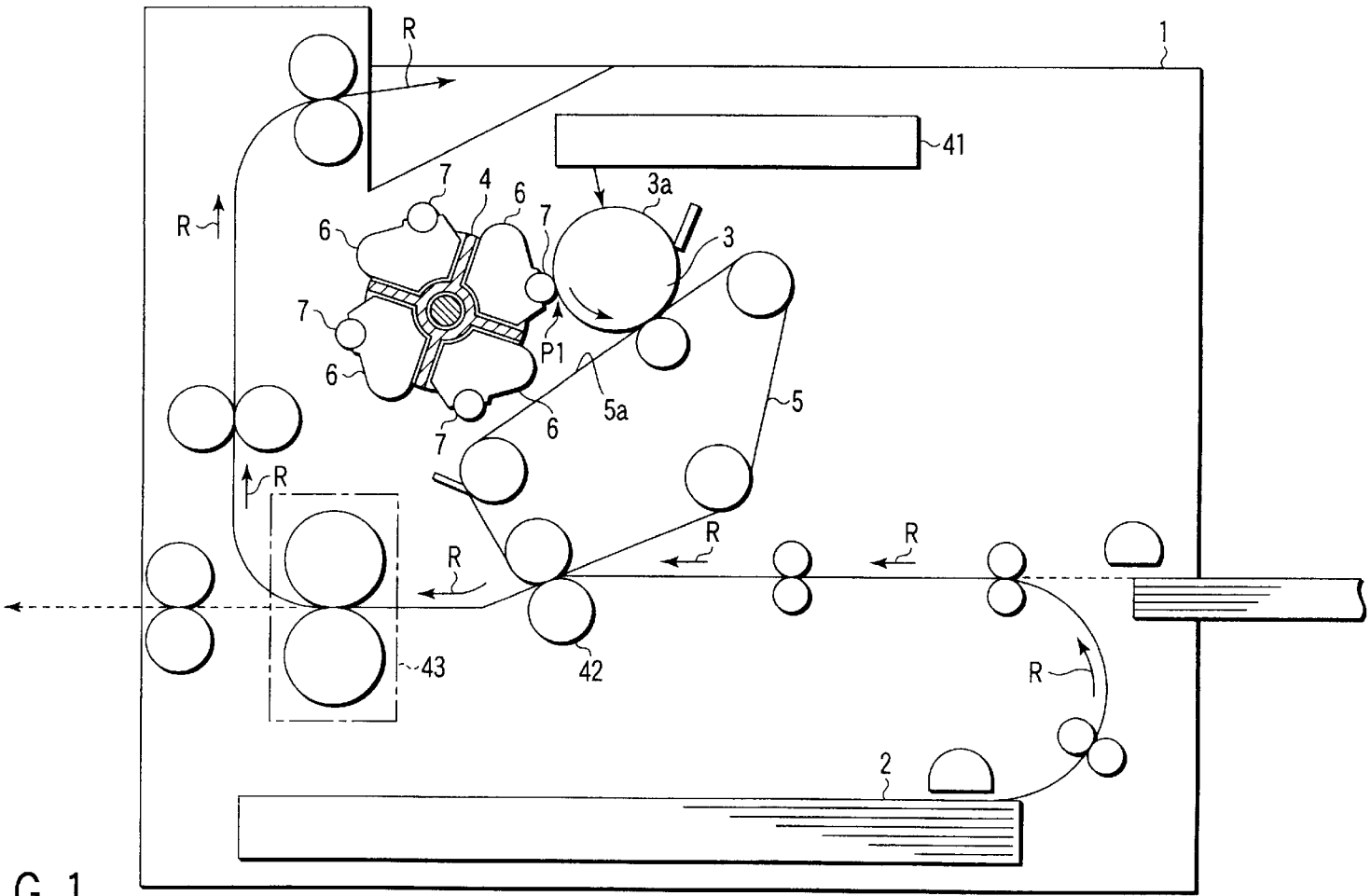
FIG. 1 is a schematic sectional view of the image forming apparatus according to the first embodiment of the present invention.

An image forming apparatus 1 according to the first embodiment of the present invention will be described, with reference to FIGS. 1 to 7. As FIG. 1 shows, the image forming apparatus 1 forms an image on a recording sheet 2 by performing electrophotography. The image forming apparatus 1 comprises a photosensitive drum 3 for a photosensitive member, a developing device assembly 4, an intermediary transfer belt 5, an charging device, an exposing device 41, a transfer roller 42, and a fixing device 43. The photosensitive drum 3, developing device assembly 4 and intermediary transfer belt 5 are arranged in parallel to each other. The photosensitive drum 3 and the intermediary belt 5 contact each other.

The charging device electrically charges the photosensitive drum 3. An invisible electrostatic latent image is formed on the surface 3*a* of the photosensitive drum 3, which is irradiated with light by the exposing device 41.

The developing device assembly 4 has a plurality of developing devices 6, or four devices 6 in this embodiment. Each developing device 6 has a developing roller 7. The developing roller 7 causes the electrostatic latent image formed on the surface 3*a* of the photosensitive drum 3 to attract toner by the electrostatic force. As a result, a toner image is formed on the surface 3*a* of the photosensitive drum 3, which has the electrostatic latent image. The developing devices 6 are arranged parallel relative to one another, with the developing rollers 7 facing outside. The developing device assembly 4 positions the developing roller 7 of one of the developing devices 6 at developing position P1, holding the roller 7 facing the photosensitive drum 3. The developing device assembly 4 switches the developing device 6 to the next one when it is rotated. The developing devices 6 contain toners of different colors, including yellow, magenta, cyan and black in this embodiment. The image forming apparatus 1 can therefore form multi-color images.

The toner image that each of the developing device 6 has formed on the surface 3*a* of the photosensitive drum 3 is transferred from the photosensitive drum 3 onto the surface 5*a* of the intermediary transfer belt 5. The toner images are formed, sequentially one upon another, on the surface 5*a* of the intermediary transfer belt 5. They are collectively transferred onto the recording sheet 2 that has been conveyed along arrow R shown in FIG. 1. The recording sheet 2, which has transferred a toner image, is moved further along the arrow R, passes by the fixing device 43, and leaves the image forming apparatus 1.

Figure 2:
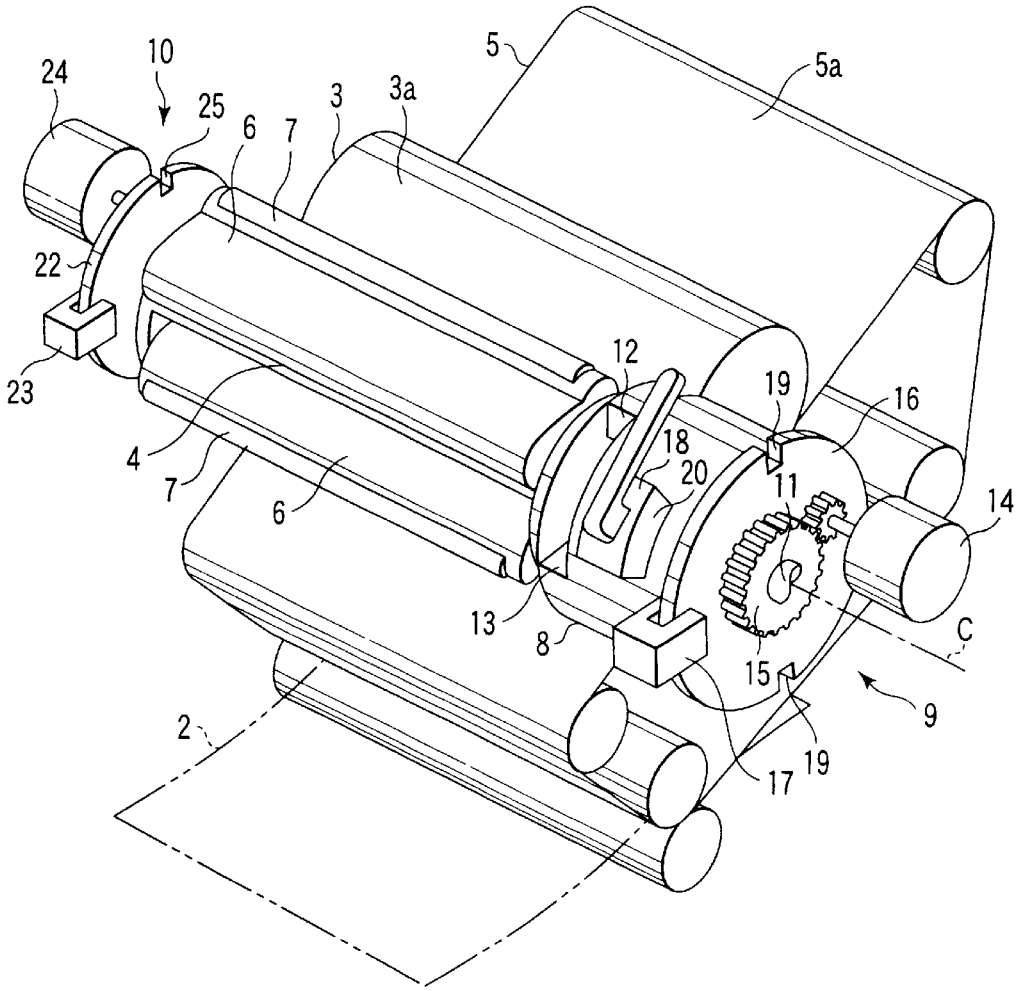
FIG. 2 is a schematic perspective view of the developing device assembly and the mechanisms provided around the assembly in the image forming apparatus of FIG. 1.
Figure 3:
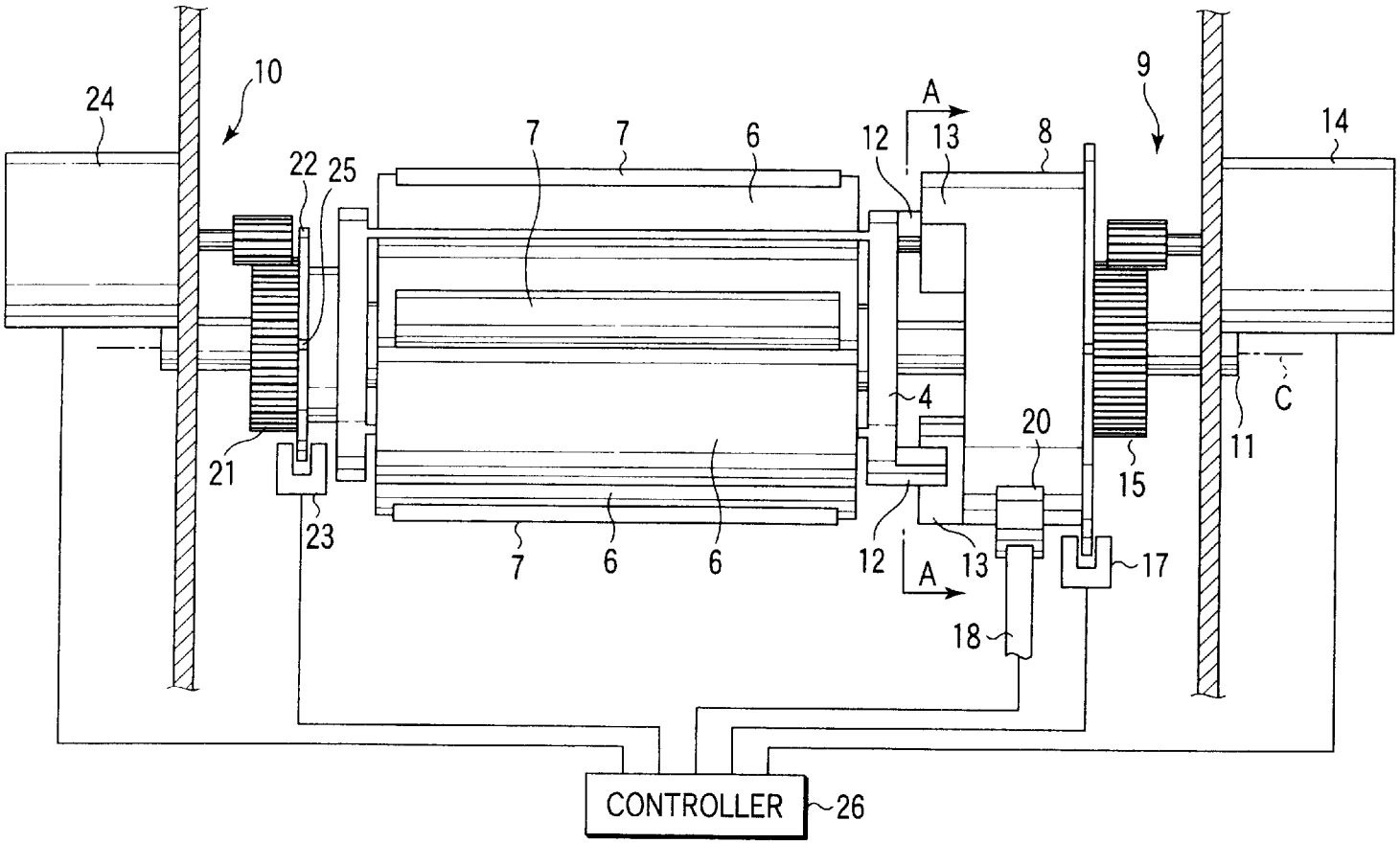
FIG. 3 is a schematic plan view of the developing device assembly and the like, shown in FIG. 2.

The image forming apparatus 1 further comprises an inertia acceptor 8, a setting mechanism 9, and a positioning mechanism 10. The mechanism 10 is used for the developing device assembly 4. FIG. 2 shows the photosensitive drum 3, developing device assembly 4, intermediary transfer belt 5, inertia acceptor 8, setting mechanism 9 and positioning mechanism 10 of the developing device assembly 4. FIG. 3 is a plan view of the developing device assembly 4, inertia acceptor 8, setting mechanism 9 and positioning mechanism 10, all shown in FIG. 2. The inertia acceptor 8 and the setting mechanism 9 are arranged at an end of the developing device assembly 4. The positioning mechanism 10 of the developing device assembly 4 is arranged at the other end of the developing device assembly 4.

The inertia acceptor 8 is arranged on the axis C of the rotary shaft 11 of the developing device assembly 4. The inertia acceptor 8 can revolve around the axis C, independently of the developing device assembly 4. The inertia acceptor 8 has a mass sufficient to stop the rotation of the developing device assembly 4 when it receives the energy of rotational inertia from the developing device assembly 4. Once the developing device assembly 4 shifts the energy of rotational inertia to the inertia acceptor 8, it stops without vibrating at all.

The developing device assembly 4 has a strike portion 12. The inertia acceptor 8 has a stricken portion 13. The energy of rotational inertia is shifted from the developing device assembly 4 to the inertia acceptor 8 when the strike portion 12 is made to collide with the stricken portion 13.

The setting mechanism 9 has a motor 14, a gear 15, a disk 16, a detector 17, and a braking mechanism 18. The motor 14 is in mesh with the gear 15. The gear 15 and the disk 16 are arranged to rotate with the inertia acceptor 8. The motor 14 rotates the inertia acceptor 8 by way of the gear 15. The disk 16 has marks 19 for detecting the setting positions P2, P3, P4 and P5 of the inertia acceptor 8. The marks 19 are, for example, notches formed along the outer periphery of the disk 16 as is illustrated in FIG. 2. The detector 17 detects the marks 19 on the disk 16. The braking mechanism 18 has a pad 20. The pad 20 is pushed against the inertia acceptor 8, dampening and finally stopping the rotation of the inertia acceptor 8.

The positioning mechanism 10 has a gear 21, a disk 22, a detector 23, and a drive unit 24. The gear 21 and the disk 22 are arranged to rotate with the developing device assembly 4. The disk 22 has marks 25, for detecting the developing position P1 where the each developing devices 6 of the developing device assembly faces the photosensitive drum 3. The marks 25 are, example, notches formed along the outer periphery of the disk 22 as is shown in FIG. 2. The detector 23 detects the marks 25 on the disk 22. The drive unit 24 meshes with the gear 21 as shown in FIG. 3, and rotates the developing device assembly 4. Any other positioning mechanism can be used in this embodiment, if positions the developing device assembly 4 with respect to the photosensitive drum 3 so that each developing devices 6 may sufficiently develop a latent image. The positioning mechanism 10 may be arranged at the same side of the developing device assembly 4 as the inertia acceptor 8 is arranged.

As FIG. 3 shows, a controller 26 controls the setting mechanism 9 and the positioning mechanism 10. The controller 26 controls the motor 14, drive unit 24 and braking mechanism 18 in accordance with the developing position P1 of the developing device assembly 4, detected by the detector 23, and the setting position P2, P3, P4 or P5 of the inertia acceptor 8, detected by the detector 17. Thus, the controller 26 places the developing device assembly 4 at the developing position P1 and the inertia acceptor 8 at one of the setting positions P2, P3, P4 and P5, by controlling the motor 14, drive unit 24 and the braking mechanism 18, as the detectors 17 and 23 detect the marks 19 and 25, respectively. The controller 26 synchronizes the movement of the developing device assembly 4 and the inertia acceptor 8.

Figure 4:
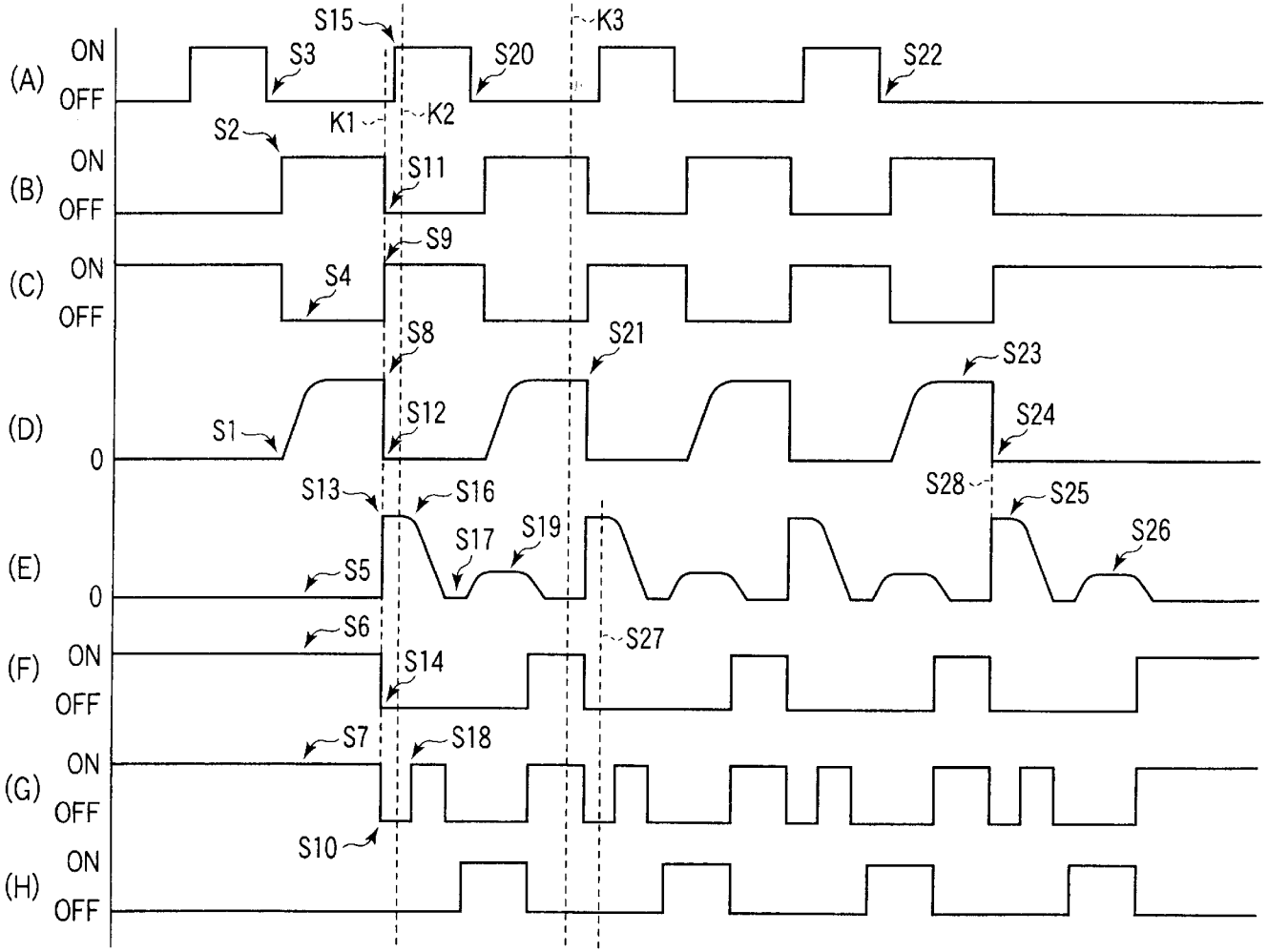
FIG. 4 is a timing chart showing how the operating states of the developing device assembly and the like, illustrated in FIG. 3, change with time.

The developing device assembly 4, inertia acceptor 8, setting mechanism 9 and positioning mechanism 10 will be described, for their respective movements, with reference to FIGS. 4 to 7. FIG. 4 shows how these components move with time. In FIG. 4, (A) indicates the operating state of the developing devices; ON means the active state, and OFF means the inactive state. In FIG. 4, (B) shows the state of the drive unit; ON means that the devices are operating, and OFF means that they are at stop. In FIG. 4, (C) shows the detecting operation of the detector 23 of the positioning mechanism 10; ON means that the developing device 6 is located at the developing position, and OFF means that the developing device 6 is located outside the developing position. In FIG. 4, (D) indicates the rotational speed of the developing device assembly 4. In FIG. 4, (E) indicates the rotational speed of the inertia acceptor 8. In FIG. 4, (F) depicts the detecting condition of the detector 17 of the setting mechanism 9; ON means that the inertia acceptor 8 is located at the setting position, and OFF means that the inertia acceptor 8 is located outside the setting position. In FIG. 4, (G) shows the state of the braking mechanism 18; ON means that mechanism 18 is operating, and OFF means the mechanism 18 is at stop. In FIG. 4, (H) indicates the operating state of the motor 14 of the setting mechanism 9; ON means that the motor 14 is operating, and OFF means that the motor 14 is at stop.

Figure 5:
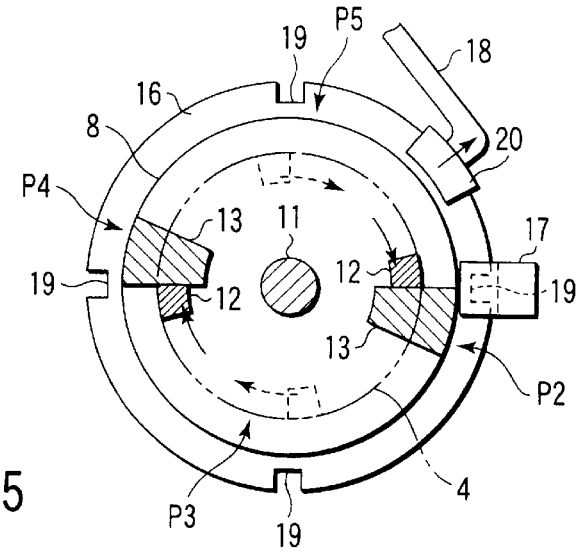
FIG. 5 is a schematic sectional view taken along line A—A in FIG. 3, representing the positional relation between the developing device assembly and the inertia acceptor, at K1 in FIG. 4.
Figure 6:
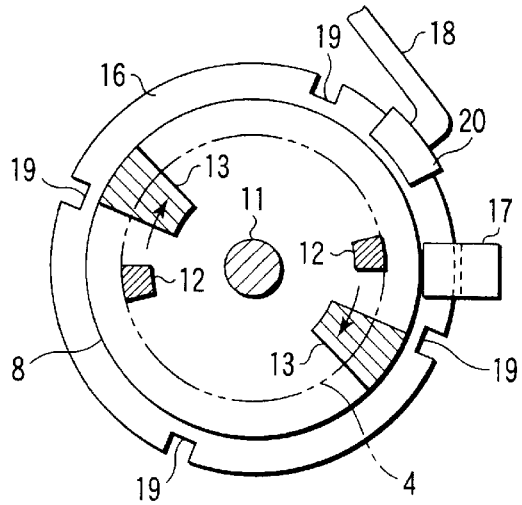
FIG. 6 is a schematic sectional view taken along line A—A in FIG. 3, showing the positional relation between the developing device assembly and the inertia acceptor, at K2 in FIG. 4.
Figure 7:
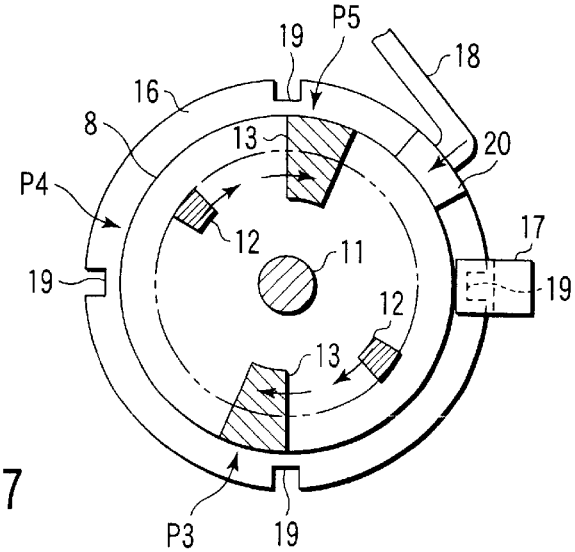
FIG. 7 is a schematic sectional view taken along line A—A in FIG. 3, illustrating the positional relation between the developing device assembly and the inertia acceptor, at K3 in FIG. 4.
Figure 8:
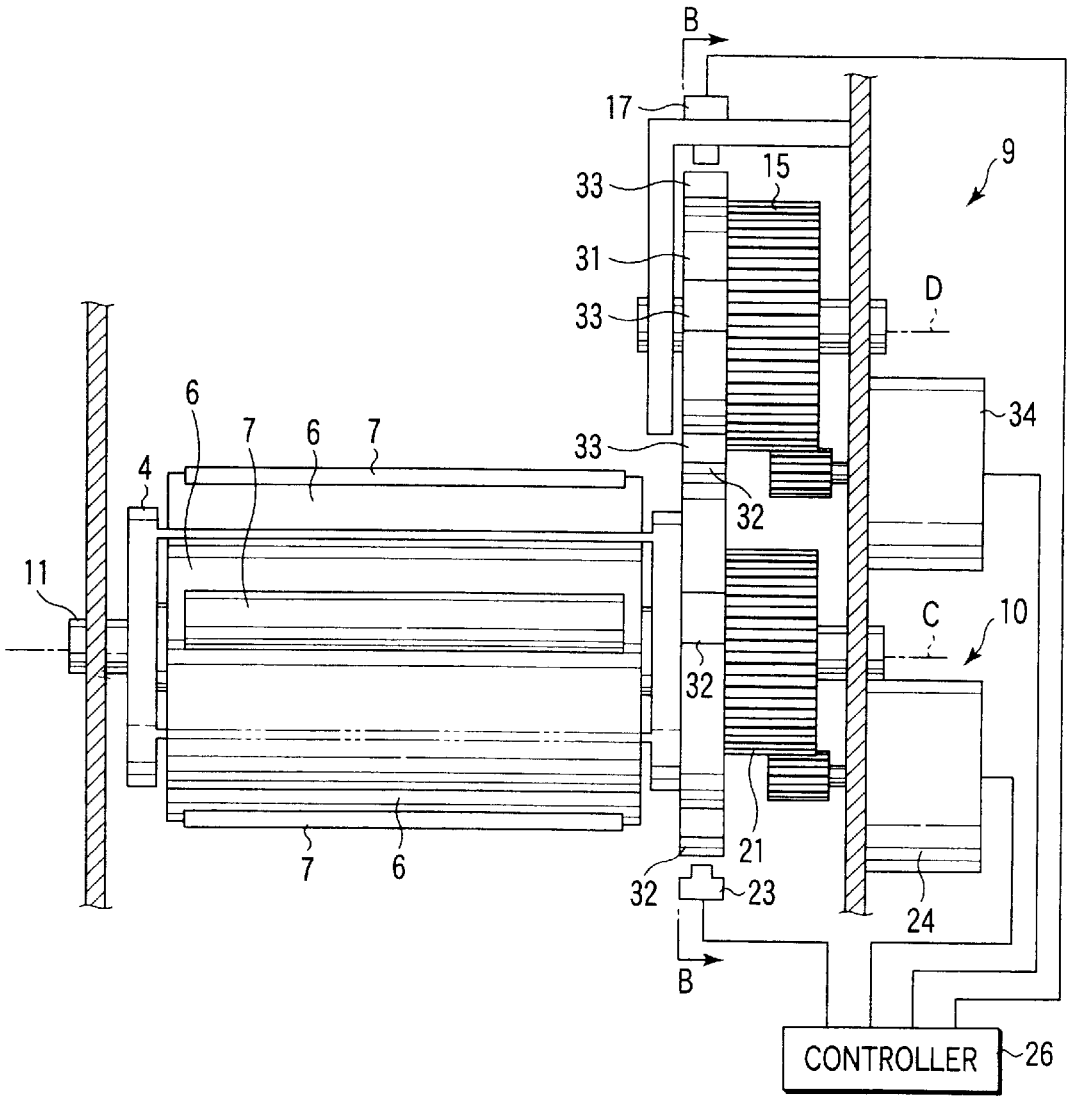
FIG. 8 is a schematic plan view of the developing device assembly and some other components of the image forming apparatus according to the second embodiment of the present invention.

FIG. 5 represents the positional relation that the developing device assembly 4 and the inertia acceptor 8 have at time K1 in FIG. 4. At time K1, the strike portion 12 of the developing device assembly 4 collides with the stricken portion of the inertia acceptor 8. FIG. 6 shows the positional relation that the developing device assembly 4 and the inertia acceptor 8 have at time K2 in FIG. 4. At time K2, the developing device assembly 4 shifts the energy of rotational inertia to the inertia acceptor 8 and then stops operating. The inertia acceptor 8, which has received the energy of rotational inertia, rotates. FIG. 7 shows the positional relation that the developing device assembly 4 and the inertia acceptor 8 have at time K3 in FIG. 4. The braking mechanism 18 holds the inertia acceptor 8 at the next setting position. After finishing the second development, the developing device assembly 4 rotates to set the next developing device in the developing position.

How the developing device assembly 4, inertia acceptor 8, setting mechanism 9 and positioning mechanism 10 operate in sequence will be described. The developing device assembly 4 starts to rotate at S1 when the drive unit 24 starts operating to switch to the second developing device 6, after the first developing device 6 has been finished the development. The detector 23 of the positioning mechanism 10 of the developing device assembly 4 indicates that the developing device assembly 4 is off the developing position P1 at S4. As indicated by S5, the inertia acceptor 8 stops at the setting position P2 to stop the next developing device 6 of the developing device assembly 4 at the developing position P1. The detector 17 of the setting mechanism 9 indicates that the inertia acceptor 8 stays at the setting position P2 as indicated by S6. The braking mechanism 18 holds the inertia acceptor 8 at the setting position P2 as indicated by S7.

When the strike portion 12 collides with the stricken portion 13 at S8 as shown in FIG. 5 after the developing device assembly 4 has rotated, the energy of rotational inertia is shifted from the developing device assembly 4 to the inertia acceptor 8. At this moment, the detector 23 detects, as indicated by S9, that the second developing device 6 has been set in the developing position P1. The braking mechanism 18 releases the inertia acceptor 8 at S10 on the basis of the signal from the detector 23. The drive unit 24 stops operating at S11 on the basis of the signal from the detector 23.

The developing device assembly 4, which has shifted the energy of rotational inertia, stops as indicated by S12. On the other hand, the inertia acceptor 8, which has received the energy of rotational inertia, starts rotating as shown by S13. The detector 17 detects that the inertia acceptor 8 has started to rotate as indicated by S14. The second developing device 6 starts a developing operation as indicated by S15 on the basis of the signal from the detector 23. The controller 26 decelerates the rotating inertia acceptor 8 at a rate that is sufficient but does not vibrate the inertia acceptor 8, as is indicated by S16 by controlling the braking mechanism 18 as indicated by S18 on the basis of the signal from the detector 17. The controller 26 then stops the acceptor 8 at S17. As S19 indicates, the motor 14 drives the inertia acceptor 8 to the setting position P3 that make the third developing device 6 stop at the developing position P1, during a period between S20 when the second developing device 6 completes the developing and S21 when the third developing device 6 turns to the developing position P1. The sequence of operation is repeated for each developing device 6. The position, where the strike portion 12 and the stricken portion 13 collide, moves as the developing device 6 is switched to the next one.

After the last developing device 6 has completed the developing operation at S22, the developing device assembly 4 rotates to bring the first developing device 6 to the developing position P1 as indicated by S23, in preparation for prepare the next cycle of image forming operation. When the first developing device 6 reaches the developing position P1, the developing device assembly 4 collides with the inertia acceptor 8 that is located at the setting position P5.

The first developing device 6 stops at S24. As S25 indicates, the inertia acceptor 8 is moved, from the setting position P5 since it has collided with the developing device assembly 4. The controller 26 may set the inertia acceptor 8, moved from the setting position P5, at the next setting position P2. The operation of setting the inertia acceptor 8 at the setting position P2 as shown by S26 is performed after the next image forming cycle starts and before the first developing device 6 is switched to the second developing device 6. As described above, the image forming apparatus 1 has two pair of the strike portion 12 and stricken portion 13. Nonetheless, the present embodiment may have one pair, three pairs or four pairs of a strike portion 12 and a stricken portion 13. The energy of rotational inertia may be shifted from the developing device assembly 4 to the inertia acceptor 8 by means of a clutch, a cam or the like, not by collision between the assembly 4 and the acceptor 8.

The time between the stop of the rotation of the developing device assembly 4 and the start of the next developing sequence is shortened, because the energy of rotational inertia is shifted from the developing device assembly 4 to the inertia acceptor 8.

Figure 9:
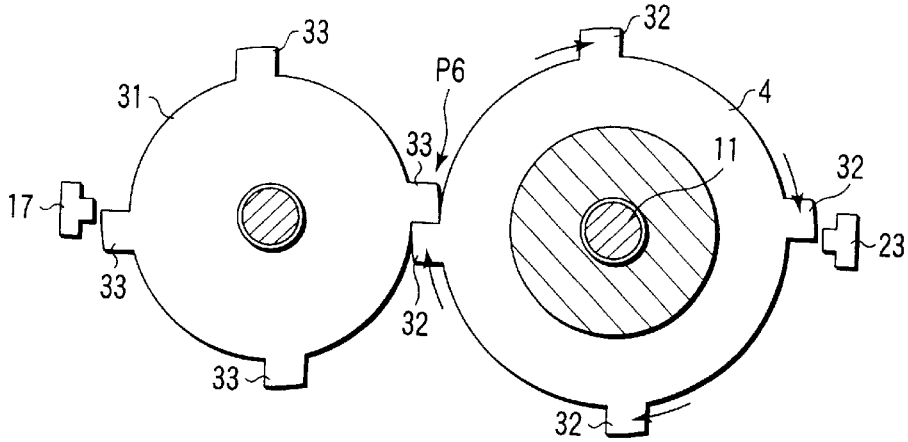
FIG. 9 is a schematic cross sectional view taken along line B—B in FIG. 8, showing a state in which the developing device assembly collides with the inertia acceptor, at a strike portion and a stricken portion.
Figure 10:
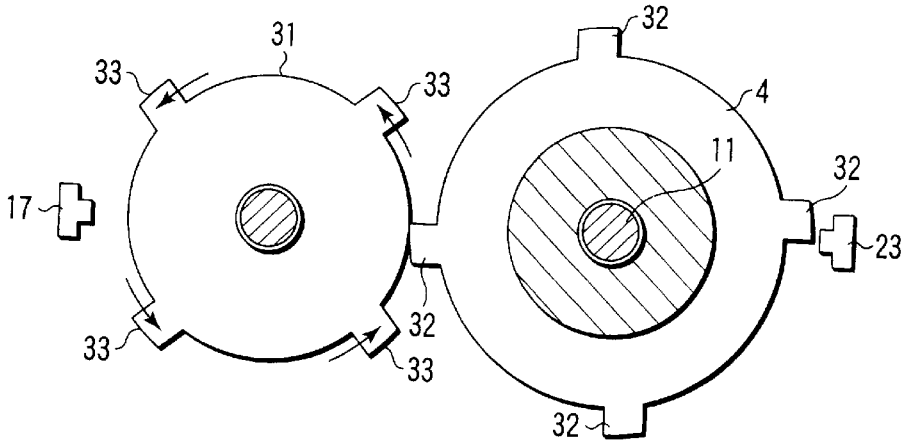
FIG. 10 is a schematic sectional view taken along line B—B in FIG. 8, showing a state in which the inertia acceptor is shifted the energy of rotational inertia from the developing device assembly and starts rotating.
Figure 11:
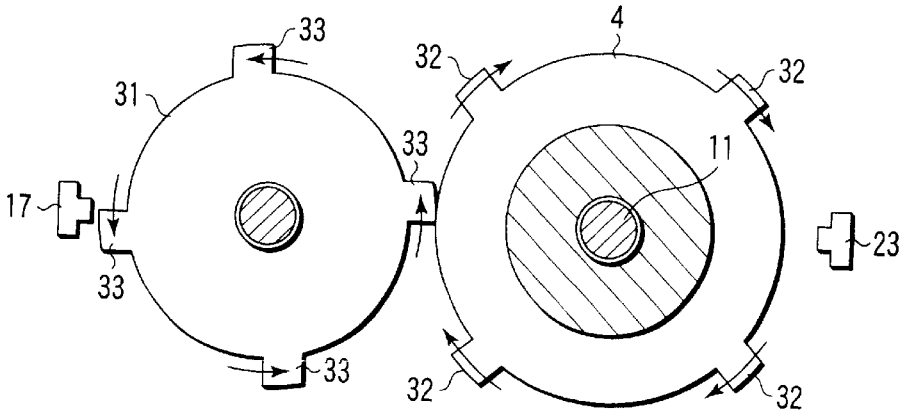
FIG. 11 is a schematic sectional view taken along line B—B in FIG. 8, showing a state in which the inertia acceptor is located at the next setting position and the developing device assembly is rotating to switch one developing device to the next one.

An image forming apparatus according to the second embodiment of the present invention will be described, with reference to FIG. 4 and FIGS. 8 to 11. The components identical or similar to those of the image forming apparatus 1 according to the first embodiment are designated at the same reference numerals and will not be described. The sequence of operation of the developing device assembly 4, inertia acceptor 8, setting mechanism 9 and positioning mechanism 10 of the image forming apparatus according to the second embodiment may be described with reference to FIG. 4, too. FIG. 9 shows the positional relation between the developing device assembly 4 and the inertia acceptor 8, at K1 in FIG. 4. FIG. 10 shows the positional relation between the developing device assembly 4 and the inertia acceptor 8, at K2 in FIG. 4. FIG. 11 shows the positional relation between the developing device assembly 4 and the inertia acceptor 8, at K3 in FIG. 4.

The image forming apparatus according to the second embodiment has an inertia acceptor 31 arranged to rotate around axial line D that is parallel to the axis C of the developing device assembly 4. The strike portion 32 of the developing device assembly 4 and the stricken portion 33 of the inertia acceptor 31 collides with each other at a position.

The detector 23 for detecting the developing position P1 of the developing device assembly 4 is designed to detect the strike portion 32. The strike portion 32 works as a mark for the detector 23. Similarly, the detector 17 for detecting a setting position P6 of the inertia acceptor 31 is designed to detect the stricken portion 33. The stricken portion 33 works as a mark for the detector 17 for detecting the setting position P6 of the inertia acceptor 31.

Motor 34 engages with the gear 15 arranged on the inertia acceptor 31 and makes the inertia acceptor 31 rotate, decelerate and stop. The motor 34 also functions as a braking mechanism. The motor 34 operates for a combination of (G) and (H) in FIG. 4. In the inoperative state S27 in both (G) and (H) in FIG. 4, the inertia acceptor 8 can freely rotate.

All other components are identical to their counterparts of the image forming apparatus according to the first embodiment, they are designated at the same reference numerals and will not be described.

In the image forming apparatus described above, the controller 26 controls the developing device assembly 4, inertia acceptor 31, setting mechanism 9 and positioning mechanism 10. However, after the collision as shown by S28, the operation of S26 of setting the inertia acceptor 31 to the setting position P6 is performed during a period between the start of the next developing sequence and the S8 when the second developing device 6 reaches the developing position P1.

When the developing device 6 of the developing device assembly 4 is switched to the next developing device 6, the energy of rotational inertia is shifted from of the developing device assembly 4 to the inertia acceptor 31, by causing the strike portion 32 to collide with the stricken portion 33 as shown in FIG. 9. The developing device assembly 4 stops as shown in FIG. 10, because the energy of rotational inertia has been shifted to the inertia acceptor 31. As FIG. 10 shows, the inertia acceptor 31 rotates when it receives the energy of rotational inertia from the developing device assembly 4.

While the developing device assembly 4 is rotating further to switch from the developing device 6 to the next, the inertia acceptor 31 is set at the setting position P6 by the setting mechanism 9 as shown in FIG. 11. The sequence of operation shown in FIGS. 9 to 11 is repeated as many times as the developing devices 6 provided. After the image forming sequence is finished, the developing device assembly 4 and the inertia acceptor 31 wait, maintaining the positional relation as shown in FIG. 10. At least a stricken portion 33 may be provided to shift the energy of rotational inertia from the developing device assembly 4 to the inertia acceptor 31 when the strike portion 32 rotates.

The image forming apparatus according to the third embodiment of the present invention will be described by referring to FIGS. 12 to 17. The components that are identical to the counterparts of the image forming apparatus according to the first embodiment are designated at the same reference numerals and will not be described.

Figure 12:
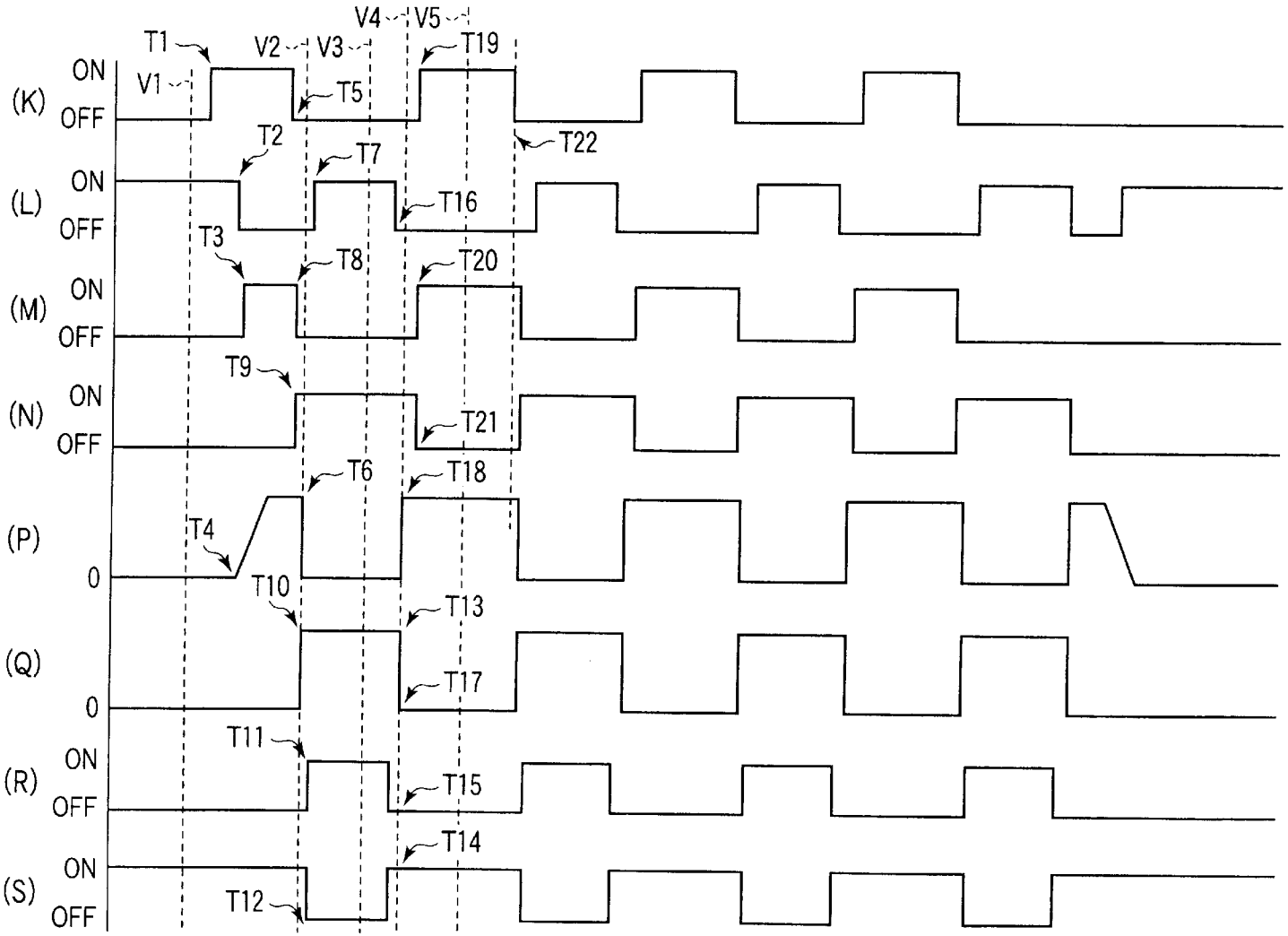
FIG. 12 is a timing chart illustrating how the operating states of the developing device assembly and the like of the image forming apparatus according to the third embodiment of the present invention change with time.

FIG. 12 illustrates how each component operates with time. In FIG. 12, (K) indicates the operating state of one of the developing devices; ON means the active state, and OFF means the inactive state. In FIG. 12, (L) shows the operating state of the braking mechanism 18; ON means the active state, and OFF means the inactive state. In FIG. 12, (M) depicts the operating state of the motor 14 of the setting mechanism 9: ON means the operating, and OFF means the stop. In FIG. 12, (N) indicates the detecting condition of the detector 17 of the setting mechanism 9; ON means that the inertia acceptor 8 is located at the setting position, and OFF means that the inertia acceptor 8 is not located at the setting position. In FIG. 12, (P) indicates the rotational speed of the inertia acceptor 8. In FIG. 12, (Q) indicates the rotational speed of the developing device assembly 4. In FIG. 12, (R) shows the operation of the drive unit; ON means operating, and OFF means stop. In FIG. 12, (S) illustrates the detecting condition of the detector 23 of the positioning mechanism 10; ON means that the developing device 6 is located at the developing position, and OFF means that the developing device 6 is not located at the developing position.

Figure 13:
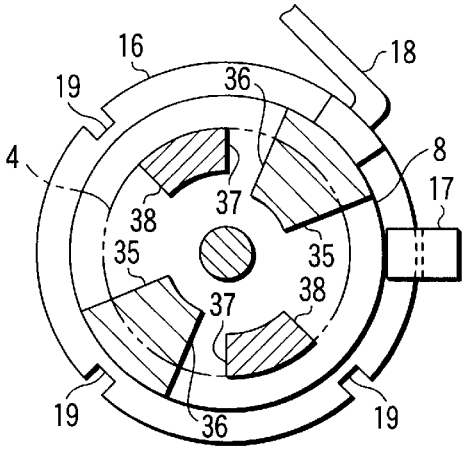
FIG. 13 is a schematic view illustrating the positional relation between the developing device assembly and the inertia acceptor, at V1 in FIG. 12.

As FIG. 13 shows, the image forming apparatus according to the third embodiment has the first strike portion 35 and the second stricken portion 36 at the inertia acceptor 8, and further has the second strike portion 37 and the first stricken portion 38 at the developing device assembly 4. In other words, the developing device assembly 4 and the inertia acceptor 8 have the strike portions 35 and 37, respectively, and the stricken portions 36 and 38, respectively. When the first strike portion 35 collides with the first stricken portion 38, the energy of rotational inertia is shifted from the inertia acceptor 8 to the developing device assembly 4. When the second strike portion 37 collides with the second stricken portion 36, the energy of rotational inertia is shifted from the developing device assembly 4 to the inertia acceptor 8.

Figure 14:
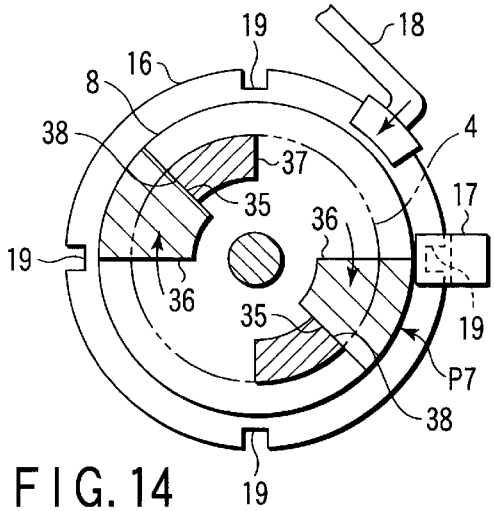
FIG. 14 is a schematic view showing the positional relation between the developing device assembly and the inertia acceptor, at V2 in FIG. 12.
Figure 15:
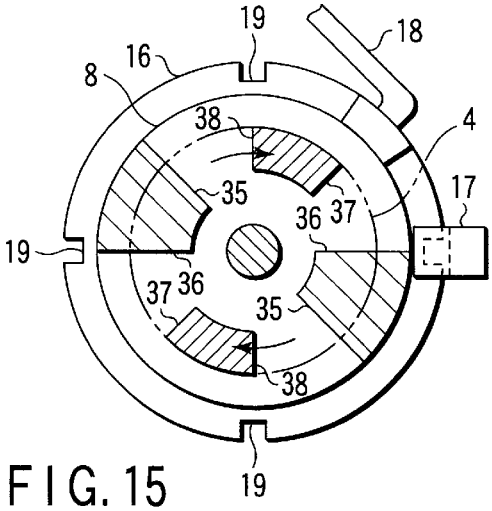
FIG. 15 is a schematic view showing the positional relation between the developing device assembly and the inertia acceptor, at V3 in FIG. 12.
Figure 16:
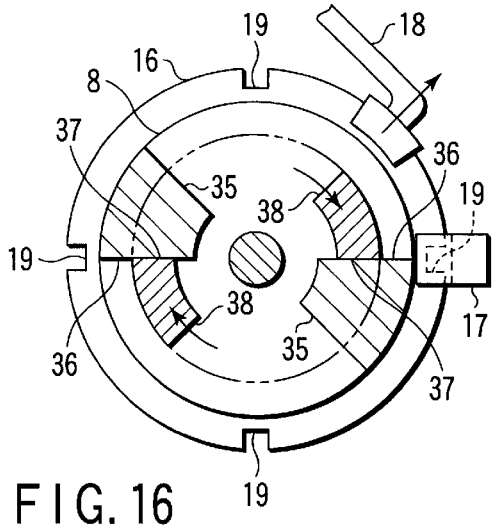
FIG. 16 is a schematic view representing the positional relation between the developing device assembly and the inertia acceptor, at V4 in FIG. 12.
Figure 17:
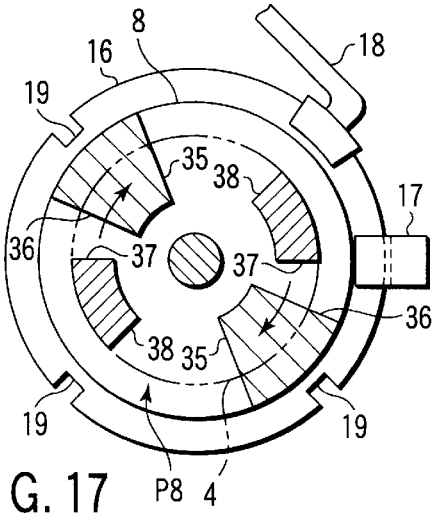
FIG. 17 is a schematic view showing the positional relation between the developing device assembly and the inertia acceptor, at V5 in FIG. 12.

FIG. 13 shows the positional relation between the developing device assembly 4 and the inertia acceptor 8, at V1 in FIG. 12. At V1, both the developing device assembly 4 and the inertia acceptor 8 wait. FIG. 14 shows the positional relation between the developing device assembly 4 and the inertia acceptor 8, at V2 in FIG. 12. At V2, the first strike portion 35 of the inertia acceptor 8 collides with the first stricken portion 38 of the developing device assembly 4. FIG. 15 shows the positional relation between the developing device assembly 4 and the inertia acceptor 8, at V3 in FIG. 12. At V3, the inertia acceptor 8 is held at the setting position P7, stopping the developing device assembly 4 to set the second developing device 6 at the developing position. After the first developing operation is completed, the developing device assembly 4 is rotated to set the second developing device to the developing position. FIG. 16 shows the positional relation between the developing device assembly 4 and the inertia acceptor 8, at V4 in FIG. 12. At V4, the second strike portion 37 of the developing device assembly 4 collides with the second stricken portion 36 of the inertia acceptor 8. FIG. 17 shows the positional relation between the developing device assembly 4 and the inertia acceptor 8, at V5 in FIG. 12. At V5, the developing device assembly 4 is held at the developing position after shifting the energy of rotational inertia to the inertia acceptor 8. The inertia acceptor 8, which has received the energy of rotational inertia from the developing device assembly 4, rotates.

In the image forming apparatus described in above, the controller 26 controls the operation sequence as shown in FIG. 12. When the first developing device 6 of the developing device assembly 4 starts a developing operation at T1, the developing device assembly 4 and the inertia acceptor 8 are located as shown in FIG. 13. The controller 26 releases the braking mechanism 18 at T2 and simultaneously starts to drive the motor 14 at T3 to rotate the inertia acceptor 8 at T4 that precedes T5, when the first developing device 6 completes its developing operation. The inertia acceptor 8 rotates to shift the energy of rotational inertia to the developing device assembly 4 after T5 when the first developing device 6 finishes the developing operation.

The inertia acceptor 8 collides with the developing device assembly 4, exactly at the next setting position P7 as shown in FIG. 14. The inertia acceptor 8 shifts the energy of rotational inertia to the developing device assembly 4 at T6 and stops at the same time. The controller 26 makes the motor 14 stop immediately at T8 before inertia acceptor 8 collides with the developing device assembly 4, as soon as the detector 17 detects that the inertia acceptor 8 rotates to the setting position P7 at T9 just before the inertia acceptor 8 collides with the developing device assembly 4. The braking mechanism 18 is started to operate at T7, after the inertia acceptor 8 has collided with the developing device assembly 4. The developing device assembly 4 starts to rotate at T10 when it has stricken, because the first strike portion 35 and the first stricken portion 38 have shifted the energy of rotational inertia from the inertia acceptor 8 to the developing device assembly 4. The controller 26 starts to operate the drive unit 24 at T11 after the signal from the detector 23 is no longer detected at T12.

The developing device assembly 4 strikes the inertia acceptor 8, exactly when the next developing device 6 sets to the developing position P1 at T13 as a result of its rotary movement as shown in FIG. 16. At T14 the detector 23 detects that the developing device assembly 4 is located at the developing position P1. The controller 26 stops the drive unit 24 at T15, immediately before the developing device assembly 4 strikes the inertia acceptor 8. At T16 the controller 26 releases the braking mechanism 18 that has been holding the inertia acceptor 8, on the basis of the signal from the detector 23. The second strike portion 37 and the second stricken portion 36 shifts the energy of rotational inertia from the developing device assembly 4 to the inertia acceptor 8 when the developing device assembly 4 has stricken the inertia acceptor 8. As a result, the developing device assembly 4 that has shifted the energy of rotational inertia to the inertia acceptor 8 stops at T17, or at the time of collision. The inertia acceptor 8 that has received the energy of rotational inertia from the developing device assembly 4 starts to rotate at T18, or at the time of collision. The developing operation of the second developing device 6 starts at T19 on the basis of the signals from the detector 23 and detector 17. The controller 26 starts to control the motor 14 at T20 when the detector 17 ceases to output signals at T21. The controller 26 makes the inertia acceptor 8 rotate toward to the next setting position P8. After the developing device 6 has finished the developing operation at T22, the inertia acceptor 8 is rotated to reach the setting position P8 shown in FIG. 17. Then, the inertia acceptor 8 strikes again the developing device assembly 4 at the setting position P8. The first strike portion 35 and the first stricken portion 38 therefore shift the energy of rotational inertia to the developing device assembly 4.

The image forming apparatus according to the third embodiment sequentially shifts the energy of rotational inertia between the developing device assembly 4 and the inertia acceptor 8. Therefore, the image forming apparatus saves a power loss and is, therefore, economical. Additionally, all time spent for forming a multi-color image can be shortened since the loss of time caused by acceleration at the beginning of rotation and deceleration at the stopping of rotation is decreased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a developing device assembly having a plurality of developing devices to develop a latent image formed on a photosensitive member and adapted to rotate in order to switch one developing device to another;

an inertia acceptor arranged to start to rotate when receiving rotational inertia energy from the developing device assembly when rotation of the developing device assembly is stopped; and a setting mechanism to control movement of the inertia acceptor driven by the rotational inertia energy shifted from the developing device assembly.

2. An image forming apparatus according to claim 1, wherein:

said inertia acceptor has a mass sufficient to stop the rotation of the developing device assembly as said inertia acceptor receives the rotational inertia energy from the developing device assembly.

3. An image forming apparatus according to claim 1, wherein:

said developing device assembly includes a strike portion, said inertia acceptor includes a stricken portion, and the rotational inertia energy is shifted from the developing device assembly to the inertia acceptor as said strike portion strikes said stricken portion at a developing position where each said developing device develops the latent image formed on the photosensitive member.

4. An image forming apparatus according to claim 1, wherein said setting mechanism comprises:

a detector to detect a setting position for the rotational inertia energy to be shifted from said developing device assembly to said inertia acceptor; and a braking device to decelerate and stop rotation of said inertia acceptor.

5. An image forming apparatus according to claim 1, wherein:

said setting mechanism comprises a motor to rotate, decelerate and stop said inertia acceptor.

6. An image forming apparatus according to claim 1, further comprising:

a positioning mechanism to position one of the developing devices of said developing device assembly at a position where the latent image formed on the photosensitive member is to be developed, and a controller to control said setting mechanism and said positioning mechanism.

7. An image forming apparatus according to claim 1, wherein:

said developing device assembly and said inertia acceptor are arranged to rotate independently around a common axis.

8. An image forming apparatus comprising:

a developing device assembly having a plurality of developing devices to develop a latent image formed on a photosensitive member and adapted to rotate in order to switch one developing device to another; and an inertia acceptor arranged to stop rotating when rotational inertia energy is shifted to said developing device assembly at a beginning of rotation of said developing device assembly, and to start to rotate when receiving rotational inertia energy from said developing device assembly when the rotation of said developing device assembly is stopped.

9. An image forming apparatus according to claim 8, wherein:

said inertia acceptor has a mass sufficient to start rotation of said developing device assembly by shifting the rotational inertia energy to said developing device assembly, and to stop the rotation of the developing device assembly by receiving the rotational inertia energy from the developing device assembly.

10. An image forming apparatus according to claim 8, wherein:

each of said developing device assembly and said inertia acceptor has a strike portion and a stricken portion, and the rotational inertia energy is shifted between said developing device assembly and said inertia acceptor when said strike portion strikes said stricken portion.

11. An image forming apparatus according to claim 8, further comprising:

a setting mechanism to control movement of said inertia acceptor which shifts the rotational inertia energy to and from said developing device assembly, and a positioning mechanism to position the developing device of said developing device assembly at a position where the latent image formed on the photosensitive member is to be developed.

12. An image forming apparatus according to claim 8, wherein:

said setting mechanism comprises a motor to rotate, decelerate, and stop said inertia acceptor.

13. An image forming apparatus according to claim 11, further comprising:

a controller to control said setting mechanism and said positioning mechanism.

* * * * *